US006641470B1

(12) United States Patent
Zhao et al.

(10) Patent No.: US 6,641,470 B1
(45) Date of Patent: Nov. 4, 2003

(54) APPARATUS FOR ACCURATE ENDPOINT DETECTION IN SUPPORTED POLISHING PADS

(75) Inventors: Eugene Y. Zhao, San Jose, CA (US); Kang Jia, Fremont, CA (US); Michael David Steiman, Milpitas, CA (US); Herbert Elliot Litvak, San Jose, CA (US); Christian David Frederickson, Pleasanton, CA (US)

(73) Assignee: Lam Research Corporation, Fremont, CA (US)

( * ) Notice: Subject to any disclaimer, the term of this patent is extended or adjusted under 35 U.S.C. 154(b) by 34 days.

(21) Appl. No.: 09/823,685

(22) Filed: Mar. 30, 2001

(51) Int. Cl.[7] ..... B24D 11/00

(52) U.S. Cl. ..... 451/523; 451/5; 451/6; 451/8; 451/10; 451/41; 451/296; 451/307; 451/287; 451/288

(58) Field of Search ..... 451/5, 6, 8, 10, 451/41, 60, 296, 307, 287, 288, 526, 520

(56) References Cited

U.S. PATENT DOCUMENTS 5,212,910 A * 5/1993 Breivogel et al. ..... 451/530
5,609,511 A * 3/1997 Moriyama et al. ..... 451/5
5,964,643 A * 10/1999 Birang et al. ..... 451/6
6,068,539 A * 5/2000 Bajaj et al. ..... 451/6
6,068,540 A 5/2000 Dickenscheid et al.
6,186,865 B1 * 2/2001 Thornton et al. ..... 451/8
6,261,155 B1 * 7/2001 Jairath et al. ..... 451/41

FOREIGN PATENT DOCUMENTS

| | | |
|---|---|---|
| EP | 0 893 203 A | 1/1999 |
| EP | 0 941 806 A | 9/1999 |
| EP | 1 176 630 A1 | 1/2002 |
| WO | 00 60650 A | 10/2000 |

OTHER PUBLICATIONS

Abstract of Japanese Patent Publication No. 2002001652, Patent Abstracts of Japan, Pub. Date: Aug. 1, 2002.

* cited by examiner

*Primary Examiner*—Joseph J. Hail, III
*Assistant Examiner*—Shantese McDonald
(74) *Attorney, Agent, or Firm*—Martine & Penilla, LLP

(57) ABSTRACT

An optical window structure is disclosed. The optical window structure includes a support layer that has a reinforcement layer and a cushioning layer. In addition, the optical windows structure has a polishing pad which is attached to a top surface of the support layer. Furthermore, the optical window structure has an optical window opening and a shaped optical window. The shaped optical window at least partially protrudes into the optical window opening in the support layer and the polishing pad during operation.

37 Claims, 14 Drawing Sheets

APPARATUS FOR ACCURATE ENDPOINT DETECTION IN SUPPORTED POLISHING PADS

BACKGROUND OF THE INVENTION

1. Field of the Invention

This invention relates generally to endpoint detection in a chemical mechanical planarization process, and more particularly to endpoint detection using a raised detection window.

2. Description of the Related Art

In the fabrication of semiconductor devices, there is a need to perform chemical mechanical planarization (CMP) operations. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to the variations in the surface topography. In other applications, metallization line patterns are formed in the dielectric material, and then, metal CMP operations are performed to remove excess metallization.

A chemical mechanical planarization (CMP) system is typically utilized to polish a wafer as described above. A CMP system typically includes system components for handling and polishing the surface of a wafer. Such components can be, for example, an orbital polishing pad, or a linear belt polishing pad. The pad itself is typically made of a polyurethane material. In operation, the belt pad is put in motion and then a slurry material is applied and spread over the surface of the belt pad. Once the belt pad having slurry on it is moving at a desired rate, the wafer is lowered onto the surface of the belt pad. In this manner, wafer surface that is desired to be planarized is substantially smoothed, much like sandpaper may be used to sand wood. The wafer may then be cleaned in a wafer cleaning system.

In the prior art, CMP systems typically implement belt, orbital, or brush stations in which belts, pads, or brushes are used to scrub, buff, and polish one or both sides of a wafer. Slurry is used to facilitate and enhance the CMP operation. Slurry is most usually introduced onto a moving preparation surface, e.g., belt, pad, brush, and the like, and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

FIG. 1A shows a cross sectional view of a dielectric layer 2 undergoing a fabrication process that is common in constructing damascene and dual damascene interconnect metallization lines. The dielectric layer 2 has a diffusion barrier layer 4 deposited over the etch-patterned surface of the dielectric layer 2. The diffusion barrier layer, as is well known, is typically titanium nitride (TiN), tantalum (Ta), tantalum nitride (TaN) or a combination of tantalum nitride (TaN) and tantalum (Ta). Once the diffusion barrier layer 4 has been deposited to the desired thickness, a copper layer 6 is formed over the diffusion barrier layer in a way that fills the etched features in the dielectric layer 2. Some excessive diffusion barrier and metallization material is also inevitably deposited over the field areas. In order to remove these overburden materials and to define the desired interconnect metallization lines and associated vias (not shown), a chemical mechanical planarization (CMP) operation is performed.

As mentioned above, the CMP operation is designed to remove the top metallization material from over the dielectric layer 2. For instance, as shown in FIG. 1B, the overburden portion of the copper layer 6 and the diffusion barrier layer 4 have been removed. As is common in CMP operations, the CMP operation must continue until all of the overburden metallization and diffusion barrier material 4 is removed from over the dielectric layer 2. However, in order to ensure that all the diffusion barrier layer 4 is removed from over the dielectric layer 2, there needs to be a way of monitoring the process state and the state of the wafer surface during its CMP processing. This is commonly referred to as endpoint detection. Endpoint detection for copper is performed because copper cannot be successfully polished using a timed method. A timed polish does not work with copper because the removal rate from a CMP process is not stable enough for a timed polish of a copper layer. The removal rate for copper from a CMP process varies greatly. Hence, monitoring is needed to determine when the endpoint has been reached. In multi-step CMP operations there is a need to ascertain multiple endpoints: (1) to ensure that Cu is removed from over the diffusion barrier layer; (2) to ensure that the diffusion barrier layer is removed from over the dielectric layer. Thus, endpoint detection techniques are used to ensure that all of the desired overburden material is removed.

Many approaches have been proposed for the endpoint detection in CMP of metal. The prior art methods generally can be classified as direct and indirect detection of the physical state of polish. Direct methods use an explicit external signal source or chemical agent to probe the wafer state during the polish. The indirect methods on the other hand monitor the signal internally generated within the tool due to physical or chemical changes that occur naturally during the polishing process.

Indirect endpoint detection methods include monitoring: the temperature of the polishing pad/wafer surface, vibration of polishing tool, frictional forces between the pad and the polishing head, electrochemical potential of the slurry, and acoustic emission. Temperature methods exploit the exothermic process reaction as the polishing slurry reacts selectively with the metal film being polished. U.S. Pat. No. 5,643,050 is an example of this approach. U.S. Pat. No. 5,643,050 and U.S. Pat. No. 5,308,438 disclose friction-based methods in which motor current changes are monitored as different metal layers are polished.

Another endpoint detection method disclosed in European application EP 0 739 687 A2 demodulates the acoustic emission resulting from the grinding process to yield information on the polishing process. Acoustic emission monitoring is generally used to detect the metal endpoint. The method monitors the grinding action that takes place during polishing. A microphone is positioned at a predetermined distance from the wafer to sense acoustical waves generated when the depth of material removal reaches a certain determinable distance from the interface to thereby generate output detection signals. All these methods provide a global measure of the polish state and have a strong dependence on process parameter settings and the selection of consumables.

However, none of the methods except for the friction sensing have achieved some commercial success in the industry.

Direct endpoint detection methods monitor the wafer surface using acoustic wave velocity, optical reflectance and interference, impedance/conductance, electrochemical potential change due to the introduction of specific chemical agents. U.S. Pat. No. 5,399,234 and U.S. Pat. No. 5,271,274 disclose methods of endpoint detection for metal using acoustic waves. These patents describe an approach to monitor the acoustic wave velocity propagated through the wafer/slurry to detect the metal endpoint. When there is a transition from one metal layer into another, the acoustic wave velocity changes and this has been used for the detection of endpoint. Further, U.S. Pat. No. 6,186,865 discloses a method of endpoint detection using a sensor to monitor fluid pressure from a fluid bearing located under the polishing pad. The sensor is used to detect a change in the fluid pressure during polishing, which corresponds to a change in the shear force when polishing transitions from one material layer to the next. Unfortunately, this method is not robust to process changes. Further, the endpoint detected is global, and thus the method cannot detect a local endpoint at a specific point on the wafer surface. Moreover, the method of the 6,186,865 patent is restricted to a linear polisher, which requires an air bearing.

There have been many proposals to detect the endpoint using the optical reflectance from the wafer surface. They can be grouped into two categories: monitoring the reflected optical signal at a single wavelength using a laser source (such as, for example, 600 nm) or using a broad band light (such as, for example, 255 nm to 700 nm) source covering the full visible range of the electromagnetic spectrum. U.S. Pat. No. 5,433,651 discloses an endpoint detection method using a single wavelength in which an optical signal from a laser source is impinged on the wafer surface and the reflected signal is monitored for endpoint detection. The change in the reflectivity as the polish transfers from one metal to another is used to detect the transition. Unfortunately, the single wavelength endpoint detection has a problem of being overly sensitive to the absolute intensity of the reflected light, which has a strong dependence on process parameter settings and the selection of consummables. In dielectric CMP applications, such single wavelength endpoint detection techniques also have a disadvantage that it can only measure the difference between the thickness of a wafer but typically cannot measure the actual thickness of the wafer.

Broad band methods rely on using information in multiple wavelengths of the electromagnetic spectrum. U.S. Pat. No. 6,106,662 discloses using a spectrometer to acquire an intensity spectrum of reflected light in the visible range of the optical spectrum. In metal CMP applications, the whole spectrum is used to calculate the end point detection (EPD signal). Significant shifts in the detection signal indicate the transition from one metal to another.

A common problem with current endpoint detection techniques is that some degree of over-etching is required to ensure that all of the conductive material (e.g., metallization material or diffusion barrier layer 4) is removed from over the dielectric layer 2 to prevent inadvertent electrical interconnection between metallization lines. A side effect of improper endpoint detection or over-polishing is that dishing 8 occurs over the metallization layer that is desired to remain within the dielectric layer 2. The dishing effect essentially removes more metallization material than desired and leaves a dish-like feature over the metallization lines. Dishing is known to impact the performance of the interconnect metallization lines in a negative way, and too much dishing can cause a desired integrated circuit to fail for its intended purpose. In view of the foregoing, there is a need for endpoint detection systems and methods that improve accuracy in endpoint detection.

FIG. 1C shows a prior art belt CMP system 10 in which a pad 12 is designed to rotate around rollers 16. As is common in belt CMP systems, a platen 14 is positioned under the pad 12 to provide a surface onto which a wafer will be applied using a carrier 18 (as shown in FIG. 1D). The pad 12 also contains a pad slot 12*a* so end point detection may be conducted as described in FIG. 1D.

FIG. 1D shows a typical way of performing end-point detection using an optical detector 20 in which light is applied through the platen 14, through the pad 12 and onto the surface of the wafer 24 being polished. In order to accomplish optical end-point detection, a pad slot 12*a* is formed into the pad 12. In some embodiments, the pad 12 may include a number of pad slots 12*a* strategically placed in different locations of the pad 12. Typically, the pad slot 12*a* is designed small enough to minimize the impact on the polishing operation. In addition to the pad slot 12*a*, a platen slot 22 is defined in the platen 14. The platen slot 22 is designed to allow the optical beam to be passed through the platen 14, through the pad 12, and onto the desired surface of the wafer 24 during polishing.

By using the optical detector 20, it is possible to ascertain a level of removal of certain films from the wafer surface. This detection technique is designed to measure the thickness of the film by inspecting the interference patterns received by the optical detector 20. Additionally, conventional platens 14 are designed to strategically apply certain degrees of back pressure to the pad 12 to enable precision removal of the layers from the wafer 24.

In typical end point detection systems such as shown in FIG. 1C, an optical opening is cut into a polishing belt. As shown in FIG. 1B, an optical opening is generally utilized within a polishing pad and a platen so a laser or light may be shined onto the wafer and a reflection may be received to determine the amount polished from the wafer.

FIG. 1E shows a dual graph 40 of end point detection data obtained from utilizing a broad spectrum of light end point detection that illustrates polishing distance detection. In an upper graph 41 showing the reflected light intensity, a curve 42 shows the intensity level of reflection for different frequencies of a light utilized for end point detection. The upper graph 41 has a vertical axis that indicates intensity and a horizontal axis showing frequency. The curve 42 with the upper graph 41 shows the differing intensity of light reflection from a wafer depending on the different frequencies of optical signals transmitted to the wafer. The intensities of light reflection as shown by the curve 42 is the optimal optical signal transmission through an optical window without any slurry on top of it. Unfortunately, when the light is blocked by slurry as occurs in prior art flat optical window systems, intensity of the light transmitted to the wafer and received back from the wafer by an optical detection unit is decreased (signal/noise decreases) as shown by a curve 44 which is a typical prior art profile curve. Therefore the curve 42 is not achieved by prior art systems when slurry accumulates in the polishing window.

Once a fourier transform 50 is conducted, a peak 46 and a curve 48 are shown in a lower graph 43 showing end point detection (EPD) intensity. The lower graph 43 has a vertical axis of intensity and a horizontal axis of thickness. The peak 46 of the lower graph 43 is produced by way of the fourier transform 50 of the curve 42, and the curve 48 is produced on the lower graph 43 by the fourier transform 50 of the curve 44. If an optical signal received by the optical detection is weak, as shown by curve 44, then the curve 48 is fuzzy and not as sharp as the peak 46 which results from reception of a strong optical signal by the light detection unit. Consequently, the curve 48 does not show as precise a film thickness polished as peak 46. Therefore, the stronger the optical signal received, the clearer measurement of film thickness that is made by the optical detection unit. Therefore, it is highly advantageous for a strong optical signal to be able to pass to the wafer or reflect from the wafer through an optical window to reach the optical detection unit.

FIG. 1F illustrates a prior art flat optical window system 60 for use during end point detection in a CMP process. In this example, a polishing pad 62 moves over platen 64 which in this example is a metallic table which may lend support to the polishing pad during the polishing action. A flat optical window 66 is attached to the polishing pad 62, and during polishing moves over a platen opening 70 which is generally a hole exposing the flat optical window 66 to an optical detector 72. Generally, flat optical windows of the prior art have a thickness of between 15 and 30 mils (a mil equals $1\times10^{-3}$ inch). As slurry 68 is deposited on top of the polishing pad 62, the slurry 68 accumulates in a polishing pad hole above the flat optical window 66. Unfortunately, the accumulation of slurry reduces reflection back of the optical signal to the optical detector 72, especially for shorter wavelength signals.

Unfortunately the prior art method and apparatus of end point detections in CMP operations as described in reference to FIGS. 1A, 1B, 1C, 1D, 1E, and 1F have various problems. The prior art apparatus also has problems with oxide removal where too much or too little may be removed due to inaccurate readings in optical endpoint detection resulting from accumulation of slurry in the flat optical window. Specifically, the accumulation of slurry often decreases the intensity of optical signal received by the optical detection unit from the wafer as shown in FIG. 1E. Because the prior art optical windows are configured to be flat in a polishing pad opening, slurry dispensed during CMP pools in the polishing pad hole. As more and more slurry flows into the polishing pad hole, more optical signal interference is created. This may significantly reduce wafer polishing accuracy and resultant wafer production reliability. Such a decrease in wafer polishing accuracy may serve to significantly increase wafer production costs. Consequently, these problems arise due to the fact that the prior art polishing belt designs do not properly control and reduce slurry accumulation on top of the optical window.

Therefore, there is a need for a method and an apparatus that overcomes the problems of the prior art by having a polishing pad structure that reduces slurry accumulation over an optical window that further enables more consistent and effective end point detection for more accurate polishing in a CMP process.

SUMMARY OF THE INVENTION

Broadly speaking, the present invention fills these needs by providing an improved optical window structure for polishing a wafer during a chemical mechanical planarization (CMP) process. The apparatus includes a new, more efficient, improved CMP pad with shaped optical windows that are more resistant to slurry accumulation and therefore increase reception of light intensity by an optical detection unit due to less slurry in an optical window hole. It should be appreciated that the present invention can be implemented in numerous ways, including as a process, an apparatus, a system, a device or a method. Several inventive embodiments of the present invention are described below.

In one embodiment, an optical window structure is provided. The optical window structure includes a support layer that has a reinforcement layer and a cushioning layer. In addition, the optical windows structure has a polishing pad which is attached to a top surface of the support layer. Furthermore, the optical window structure has an optical window opening and a shaped optical window. The shaped optical window at least partially protrudes into the optical window opening in the support layer and the polishing pad during operation.

In another embodiment, an optical window structure is provided. The optical window structure includes a support layer where the support layer has a reinforcement layer and a cushioning layer. The optical window structure also includes a polishing pad. that is attached to a top surface of the support layer and a flexible optical window, and the flexible optical window at least partially protrudes into an optical window opening in the support layer and the polishing pad when air pressure is applied to a bottom surface of the flexible optical window.

In yet another embodiment, an optical window structure is provided. The optical window structure includes a support layer where the layer has a reinforcement layer and a cushioning layer. The reinforcement layer is stainless steel and the cushioning layer is polyurethane. The optical structure also includes a polishing pad where the polishing pad is attached to a top surface of the support layer. The polishing pad is a polymeric material. The optical structure further includes a shaped optical window where the shaped optical window at least partially protrudes into an oval optical window opening in the polishing pad. A top surface of the shaped optical window is recessed between about 0.010 inch to about 0.030 inch below a top surface of the polishing pad, and the shaped optical window is one of a transparent material and a semi-transparent material.

In another embodiment, an optical window structure is provided. The optical window structure includes a support layer where the support layer has a reinforcement layer and a cushioning layer. The optical windows structure also includes a polishing pad where the polishing pad is attached to a top surface of the support layer. The optical window structure further includes an optical window opening and a shaped optical window. The shaped optical window at least partially protrudes into the optical window opening in the support layer and the polishing pad during operation. In this embodiment, the polishing pad is a polymeric material, the cushioning layer is a polymeric material, and the reinforcement layer is stainless steel.

The advantages of the present invention are numerous. Most notably, by constructing and utilizing a shaped optical window structure in accordance the present invention, the polishing pad will be able to provide more efficient and effective planarization/polishing operations over wafer surfaces (e.g., metal and oxide surfaces). Furthermore, because the wafers placed through a CMP operation using the shaped optical window structure are polished with better accuracy and more consistency, the CMP operation will also result in improved wafer yields. The shaped optical window structure of the present invention may utilize a shaped and raised optical window to keep slurry from accumulating on top of an area where optical signal may travel. Therefore, an optical detection unit utilized during end point detection may transmit and receive optimal optical signals through the shaped optical window to accurately determine the amount of polishing that has been completed in a CMP process.

Other aspects and advantages of the present invention will become apparent from the following detailed description, taken in conjunction with the accompanying drawings, illustrating by way of example the principles of the present invention.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION OF THE PREFERRED EMBODIMENTS

Figure 1A:
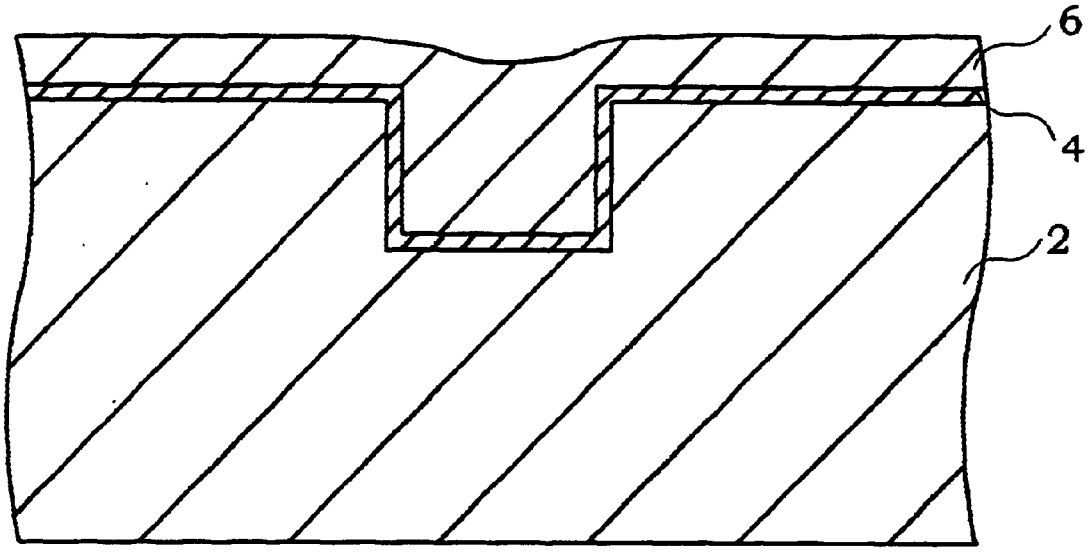
FIG. 1A (Prior Art)
FIG. 1A shows a cross sectional view of a dielectric layer undergoing a fabrication process that is common in constructing damascene and dual damascene interconnect metallization lines.
Figure 1B:
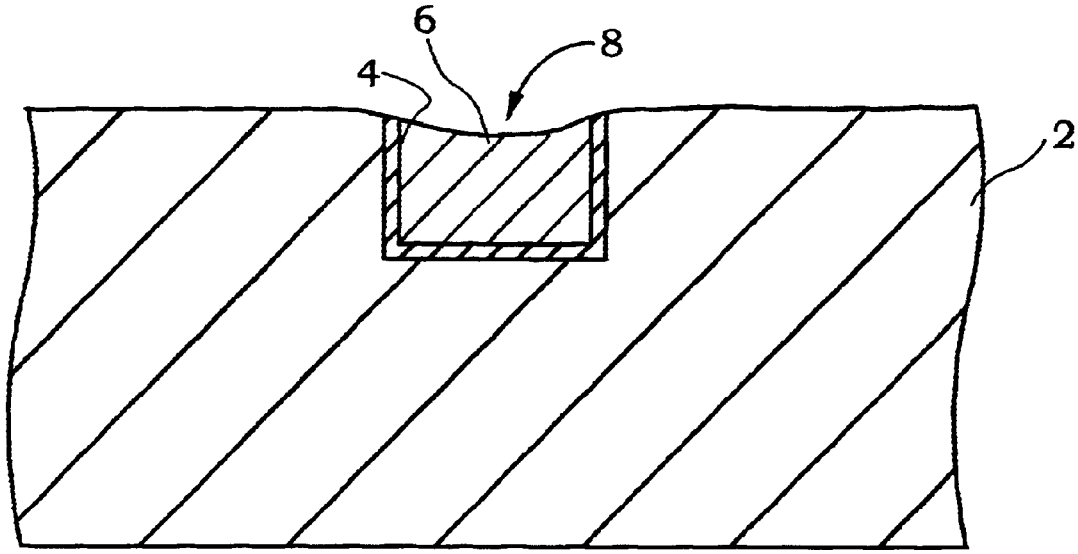
FIG. 1B (Prior Art)
FIG. 1B shows a cross sectional view of a dielectric layer after an overburden portion of the copper layer and a diffusion barrier layer have been removed
Figure 1C:
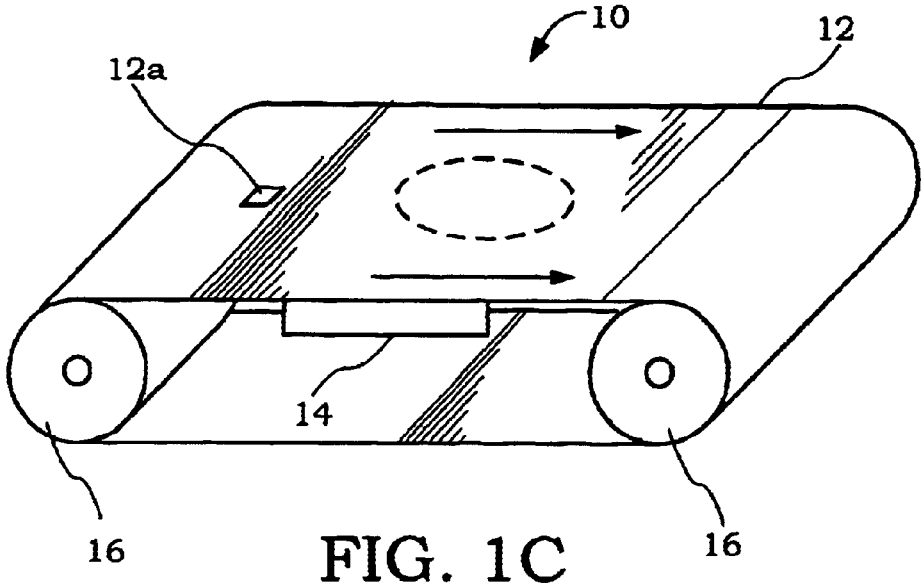
FIG. 1C (Prior Art)
FIG. 1C shows a prior art belt CMP system in which a pad is designed to rotate around rollers.
Figure 1D:
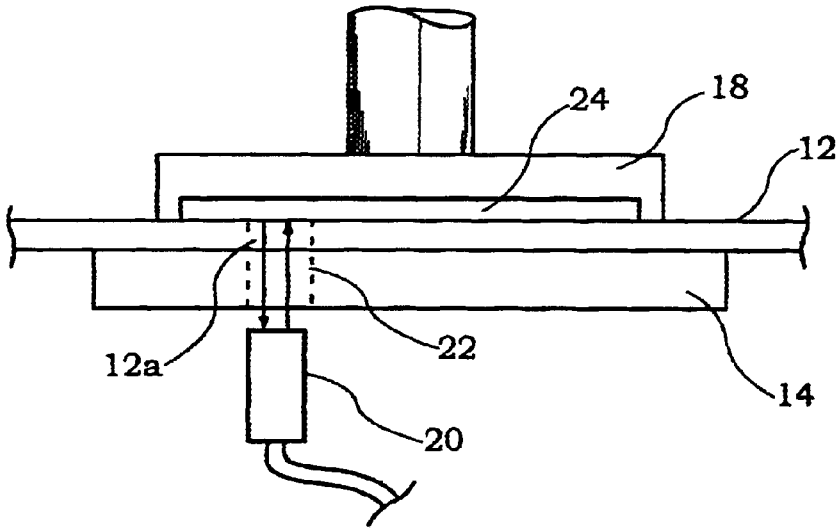
FIG. 1D (Prior Art)
FIG. 1D shows a typical way of performing end-point detection using an optical detector in which light is applied through the platen, through the pad and onto the surface of the wafer being polished.
Figure 1E:
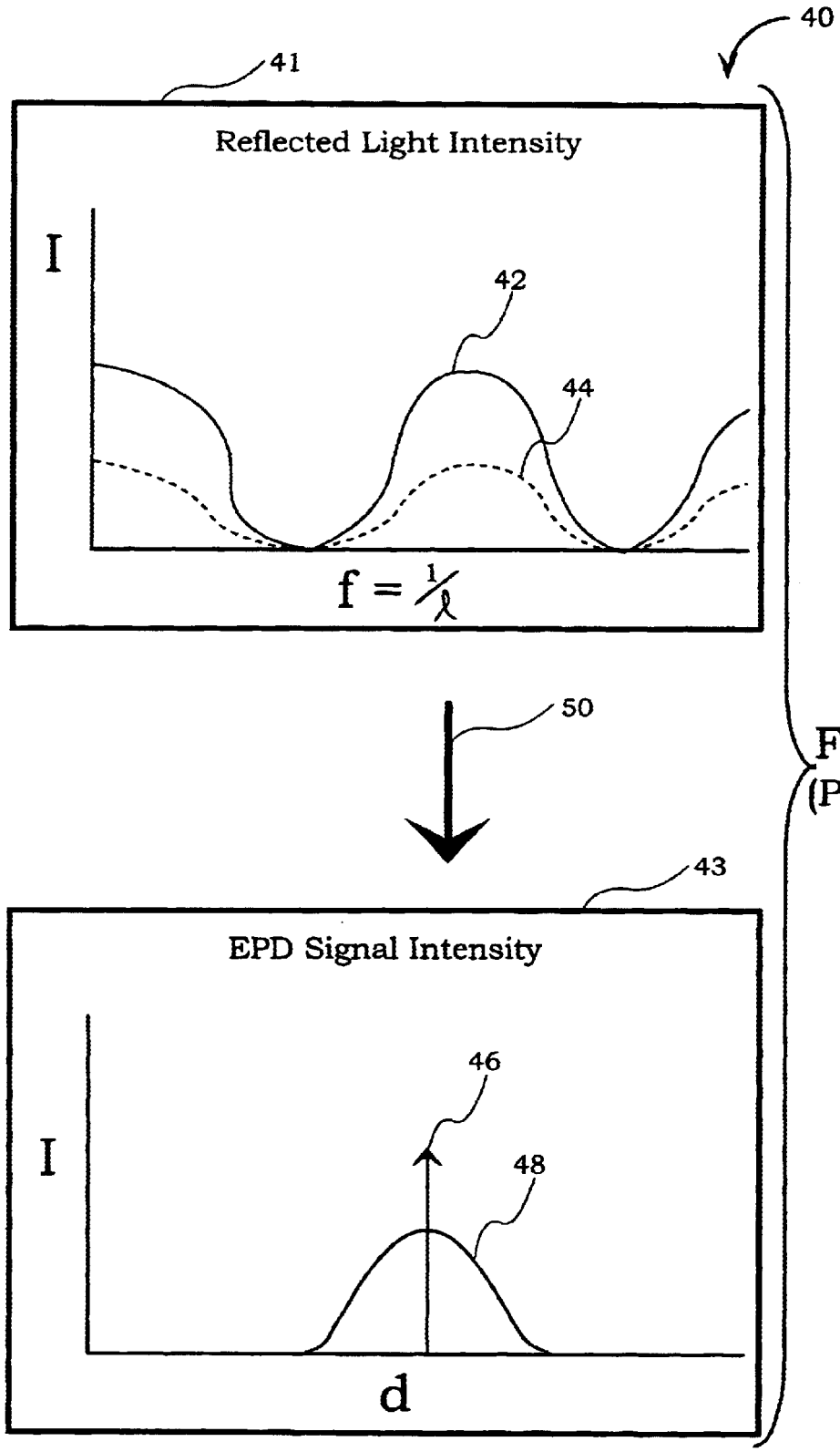
FIG. 1E (Prior Art)
FIG. 1E shows a dual graph of end point detection data obtained from utilizing a broad spectrum of light end point detection that illustrates polishing distance detection.
Figure 1F:
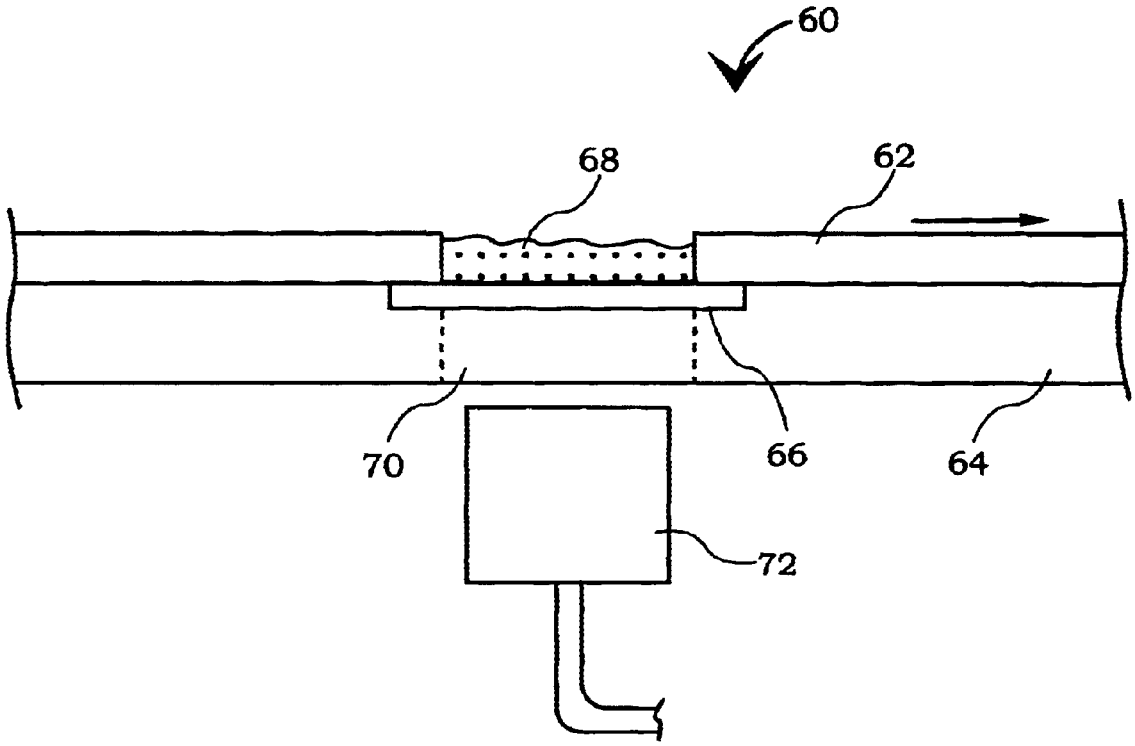
FIG. 1F (Prior Art)
FIG. 1F illustrates a prior art flat optical window system for use during end point detection in a CMP process.

An invention is disclosed for a more efficient, improved CMP pad and belt structure with shaped optical windows that are more resistant to slurry accumulation and therefore increase reception of light intensity by an optical detection unit due to less slurry in an optical window hole. In the following description, numerous specific details are set forth in order to provide a thorough understanding of the present invention. It will be understood, however, by one of ordinary skill in the art, that the present invention may be practiced without some or all of these specific details. In other instances, well known process operations have not been described in detail in order not to unnecessarily obscure the present invention.

In general terms, the present invention is directed toward a shaped optical window structure and method for conducting end point detection. It should be understood that the shaped optical window structure may also be referred to herein as an optical window structure. The shaped optical window structure includes a polishing pad with a support layer and a shaped optical window. The shaped optical window may be configured to reduce slurry accumulation on top of it. In this way, the shaped optical window may reduce the amount of optical transmission blocked by the slurry introduced during CMP. Consequently, the intensity of optical reflection received from the wafer surface through the shaped optical window of the present invention may be stronger than if a prior art flat optical window is utilized thereby optimizing determination of the amount of polishing that has been completed in a CMP process. In this way, optical signals of optimal intensity may be transmitted and received by an optical detection unit located below the shaped optical window structure and a platen to determine the amount of polishing that has been completed in a CMP process.

In a preferred embodiment, a polishing pad of the shaped optical window structure is designed and made as a contiguous and seamless unit and is preferably adhered to a support layer (which may include a cushioning layer and a reinforcement layer such as, for example a stainless steel layer, connected by an adhesive) utilizing an adhesive although any way of securing attachment may be utilized. A shaped optical window may be attached to the polishing pad or the support layer in any way which enables the optical window to reduce the amount of slurry that may accumulate on a surface of the shaped optical window such as, for example, by using adhesives. In this way, the shaped optical window may reduce the amount of optical transmission blocked by slurry introduced during end point detection. Consequently, the intensity of optical reflection received from the wafer surface through the shaped optical window of the present invention may be stronger than if a flat prior art optical window is utilized.

The shaped optical window structure may include a polishing pad (or pad layer) in addition to any other structural component that may be utilized in conjunction with the polishing pad such as, for example, the cushioning layer, the support layer, a reinforcement layer, any shaped optical window, etc. In a preferred embodiment, the reinforcement layer is a stainless steel belt. The polishing pad within the shaped optical window structure may be in either a generic pad form, a belt form, or any other form that may be utilized in a CMP process such as, for example, a seamless polymeric polishing pad, a seamless polymeric polishing belt, polymeric polishing pad, a linear belt polymeric polishing pad, polymeric polishing belt, a polishing layer, a polishing belt, etc. The polishing pad may be of a multi-layer variety that preferably includes a stainless steel reinforcement layer. Furthermore, the shaped optical window structure of the present invention may be utilized in any type of operation which may require controlled, efficient, and accurate polishing of any surface of any type of material.

One embodiment of the shaped optical window structure as described below includes three basic structural components: a polymeric polishing pad, a support layer, and a shaped optical window. The support layer, as used herein include s at least one of a cushioning layer, a reinforcement layer such as a stainless steel belt. The shaped optical window may be configured in any way which would enable the reduction of slurry from building o n top of the shaped optical window. The polishing pad may be attached to th e support layer by an adhesive film and a shaped optical window can be attached by adhesive to a bottom surface of the support layer. By using this exemplary configuration, the apparatus and method of polishing wafers optimizes CMP effectiveness and increases wafer processing throughput by way of an intelligent shaped optical window structure which enables more efficient optical signal throughput resulting in extremely accurate end point detection. It should be understood that any type of wafer planarization or polishing may be conducted utilizing the apparatus of the present invention.

Figure 2A:
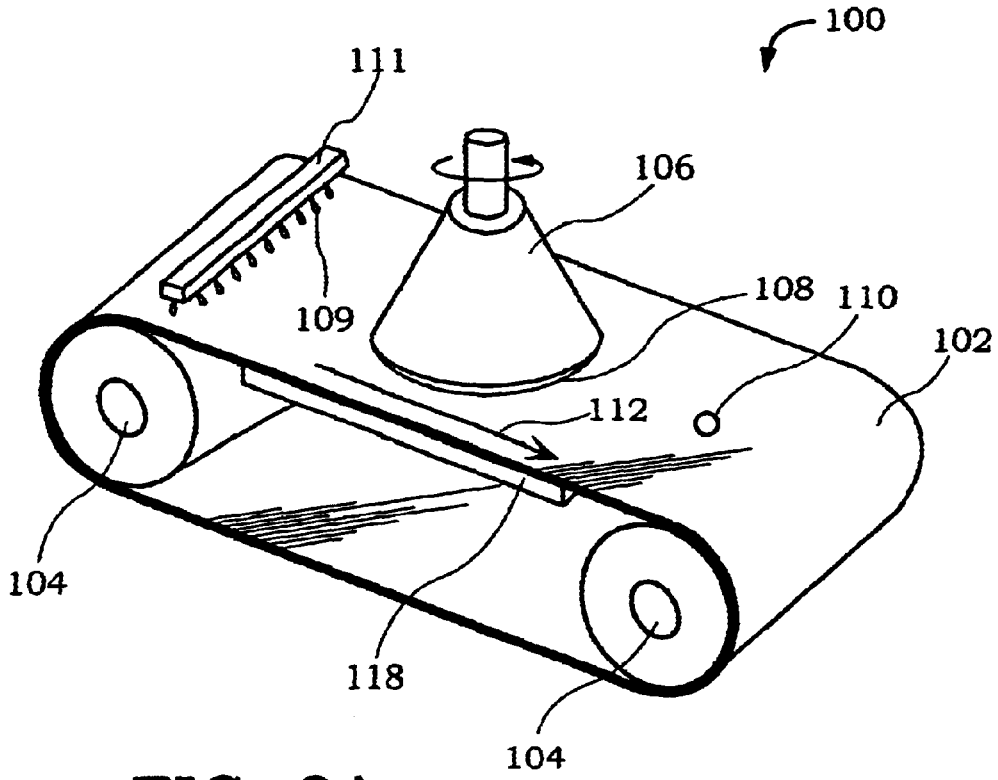
FIG. 2A shows a top view of a CMP system according to one embodiment of the present invention.

FIG. 2A shows a top view of a CMP system 100 according to one embodiment of the present invention. A polishing head 106 may be used to secure and hold a wafer 108 in place during processing. A polishing pad 102 preferably forms a continuous loop around rotating drums 104. It should be understood that the polishing pad 102 may include a polishing layer with a support layer which may include a cushioning layer and a reinforcement layer. The polishing layer may be secured to the support layer by using a any type of glue or other adhesive material such as, for example a 3M 467 adhesive. In another embodiment, the polishing layer may be secured to support layer through a direct casting of polyurethane on top of the support layer. The polishing pad 102 preferably includes an optical window 110 of the present invention through which end point detection may be conducted.

The polishing pad 102 may rotate in a direction 112 indicated by the arrow. It should be understood that the polishing pad 102 may move at any speed to optimize the planarization process. In one embodiment, the polishing pad 102 may move at a speed of about 400 feet per minute. As the belt rotates, a polishing slurry 109 may be applied and spread over the surface of the polishing pad 102 by a slurry dispenser 111. The polishing head 106 may then be used to lower the wafer 108 onto the surface of the polishing pad 102. In this manner, the surface of the wafer 102 that is desired to be planarized is substantially smoothed.

In some cases, the CMP operation is used to planarize materials such as copper (or other metals), and in other cases, it may be used to remove layers of dielectric or combinations of dielectric and copper. The rate of planarization may be changed by adjusting the polishing pressure applied to the polishing pad 102. The polishing rate is generally proportional to the amount of polishing pressure applied to the polishing pad 102 against a platen 118. In one embodiment, the platen 118 may use an air bearing which is generally a pressurized air cushion between the platen 118 and the polishing pad 102. It should be understood that the platen 118 may utilize any other type of bearing such as, for example, fluid bearing, etc. After the desired amount of material is removed from the surface of the wafer 101, the polishing head 106 may be used to raise the wafer 108 off of the polishing pad 102. The wafer is then ready to proceed to a wafer cleaning system.

In such an embodiment, the optical window 110 may be configured to keep slurry from accumulating on the optical window 110 so end point detection may be conducted in a more accurate manner thus resulting in better wafer polishing controllability. The optical window 110 of the present invention may be configured for controlled shaping during the CMP process by the pressurized air from the platen 118 or preformed when produced (i.e. shape formed before attachment to the polishing pad), or by any other way that would produce the desired configuration.

Figure 2B:
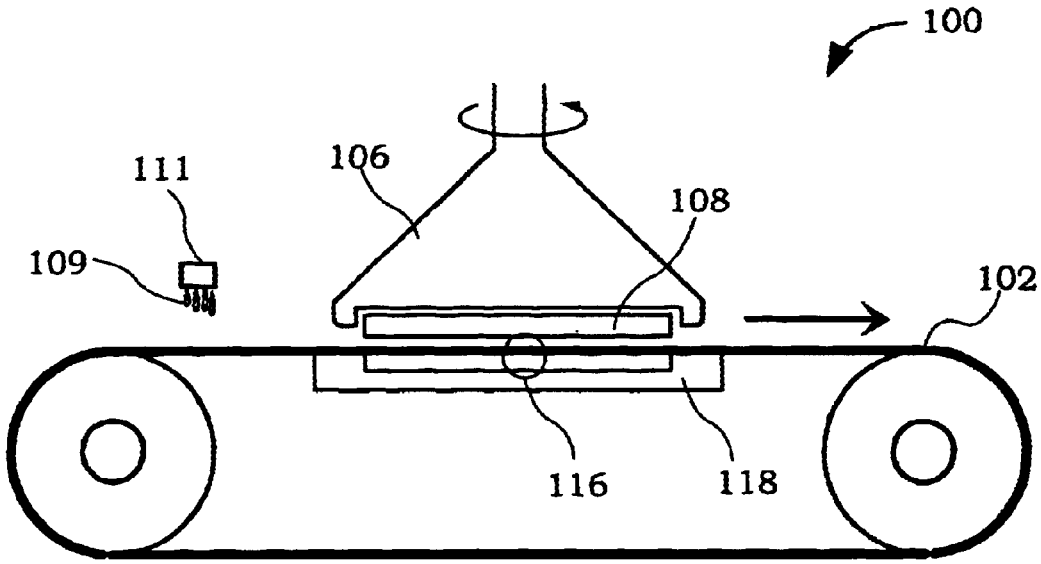
FIG. 2B shows a side view of a CMP system in accordance with one embodiment of the present invention.

FIG. 2B shows a side view of a CMP system 100 in accordance with one embodiment of the present invention. In this embodiment, the wafer 108 is lowered onto the polishing pad 102 by polishing head 106. As this happens, the slurry 109 may be applied to the polishing pad 102 by the slurry dispenser 111 to enhance the polishing of the wafer 108. An optical detection area 116 may include an optical window structure (described below in reference to FIGS. 3–13) where end point detection may be conducted. Therefore, there may be a hole in the polishing pad 102 and the platen 118 through which optical signals may be transmitted and reflected. By use of the CMP system 100, accurate polishing results may be obtained due to more precise polishing distance readings.

Figure 3:
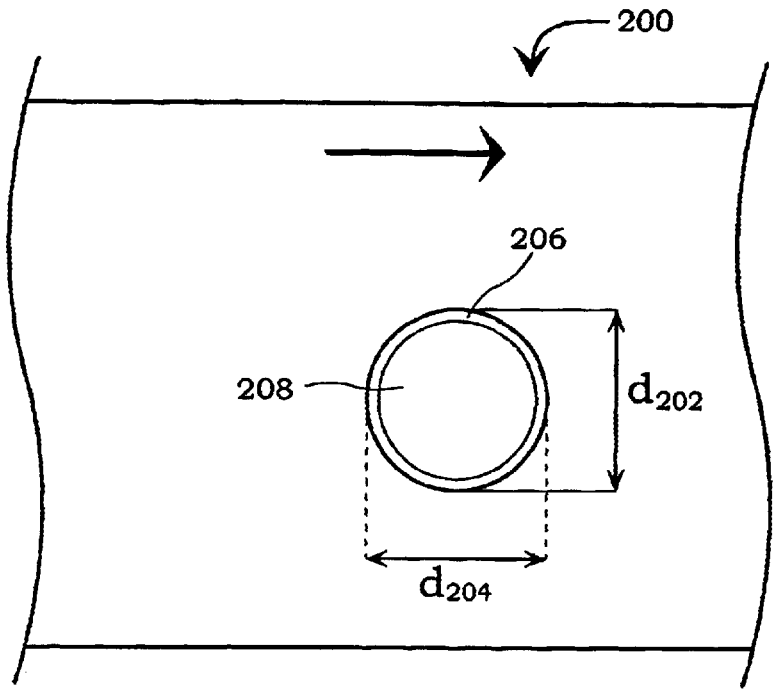
FIG. 3 shows an optical window section of a polishing pad in accordance with one embodiment of the present invention.

FIG. 3 shows an optical window section 200 of a polishing pad in accordance with one embodiment of the present invention. In this embodiment, the optical window section 200 includes an optical window opening 206 with a shaped optical window 208. It should be appreciated that other types of shaped optical windows may be utilized such as, for example, a preformed shaped optical window. Below the shaped optical window 208, an optical detection unit located below a hole or a transparent area in the platen may send optical signals through the hole and through the shaped optical window 208 to a wafer and receive optical signals that are reflected back from the wafer through the shaped optical window 208. In this way, end point detection may be accurately conducted because the configuration of the shaped optical window 208 reduces slurry accumulation on a top surface of the shaped optical window 208. It should be appreciated that the shaped optical window 208 may be any shape or size that would enable optical signals to be sent to the wafer and reflected back from the wafer so an optical detection unit may determine the amount of polishing that has been conducted by CMP such as, for example, an oval, a circle, a rectangle, a square, or any other geometric or amorphous shape.

In one embodiment when a flexible optical window is utilized (as discussed below), the optical window opening 206 has a length $d_{202}$ in the axis of polishing pad direction of about 0.5 inch to about 2.3 inches. A width $d_{204}$ of the optical window opening 206 in the axis perpendicular to the polishing pad direction may be about 0.3 inch to about 1.7 inches. In a preferable embodiment when the flexible optical window is utilized, the length $d_{202}$ can be about 1.4 inches and the width $d_{204}$ may be about 1 inch.

In another embodiment when a pre-formed shaped window is utilized (as also discussed below), the optical window opening 206 has a length $d_{202}$ of about 0.5 inch to about 1.7 inches. In this embodiment, a width $d_{204}$ of the optical window opening 206 may be about 0.4 inch to about 1.3 inches. In a preferable embodiment when the pre-formed shaped optical window is utilized, the length $d_{202}$ can be about 1.1 inches and the width $d_{204}$ may be about 0.8 inch.

By use of the shaped optical window 208, slurry buildup may be kept to a minimum and optical signal transmission through a shaped optical window structure may be kept at an optimal level.

Figure 4:
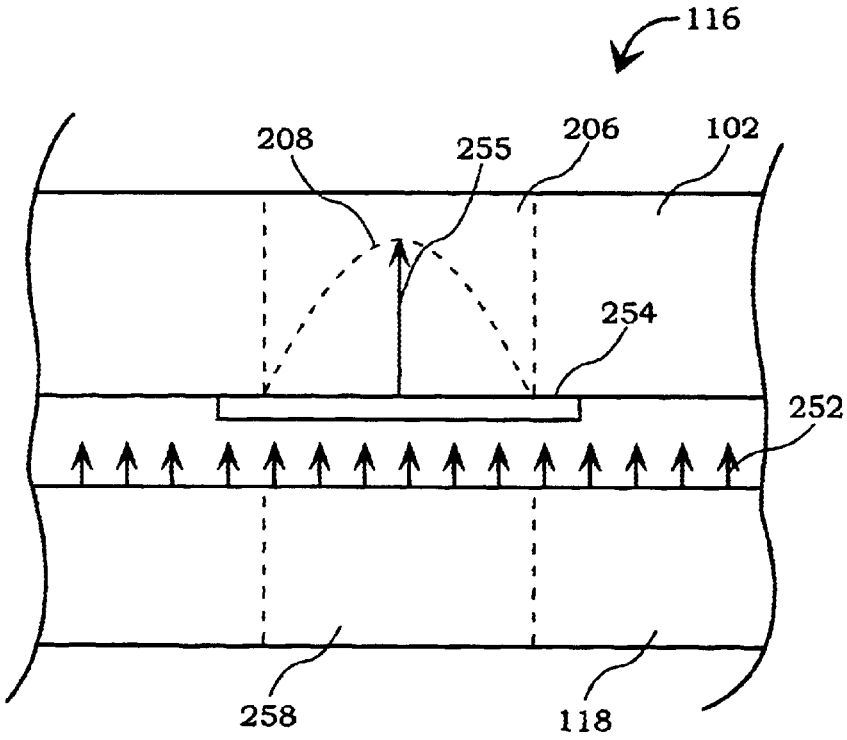
FIG. 4 shows a cut-away side view of an optical detection area in accordance with one embodiment of the present invention.

FIG. 4 shows a cut-away side view of an optical detection area 116 in accordance with one embodiment of the present invention. In one embodiment, the polishing pad 102 has an optical window opening 206. The optical window opening 206 may contain a flexible optical window 254 that moves in a direction 255 to become a shaped optical window 208 when air pressure 252 is applied from the platen 118. Therefore, in this embodiment, the flexible optical window 254 can remain flat when the polishing pad 102 is rotating around the rollers. Then when the flexible optical window 254 is rolling over the platen 118, an air pressure 252 pushes on the flexible optical window 254. The flexible optical window 254 then expands due to the air pressure 252 and takes on a bowed in configuration, as shown by the broken line) to become the shaped optical window 208 and protrude into the optical window opening 206. It should be understood that the optical window opening 206 may be any dimension that would enable accurate end point detection and proper shaping of the flexible optical window 254. Different dimensions that may be utilized regarding the optical window opening 206 is described in detail in reference to FIG. 3.

Slurry that may be preferably applied on the polishing pad can enter the optical window opening 260 and, in prior art systems, block optical signals coming in from a platen opening 258. But, in the present invention, the flexible optical window 254 is configured to controllably bow into an optical window opening 206 and slurry that had accumulated on top of the flexible optical window 254 slides off when the air pressure 252 is applied and the flexible optical window 254 becomes the shaped optical window 208. The thickness of the flexible optical window 254 may be managed to determine the amount of bowing depending on the air pressure from the platen. Once the optical window opening 260 finishes passing over the platen and the air pressure 252 is not applied, the shaped optical window 208 becomes flat and reverts back to the optical window 254. The optical window 254 remains flat until that portion of the polishing pad 102 again rolls over the platen 118. It should be appreciated that the flexible optical window 254 may be any type of transparent or semi-transparent material that may be flexible and thin enough to controllably transform into the shaped optical window with application of the air pressure 252 such as, for example, mylar, polyurethane, any transmitting polymeric material, and the like. In one embodiment, the flexible optical window is made from an polyurethane material enabling optical signal transmission that may be between about 2 mils (0.002 inch) to about 14 mils (0.014 inch) in thickness. The thickness may be varied depending on the amount of bowing in desired. In another embodiment, the flexible optical window 254 can be about 6 mils (0.006 inch) in thickness. By use of such flexible optical window that may transform into a shaped optical window, the present invention reduces slurry buildup on a top surface of the shaped optical window thereby optimizing optical signal transmission through the shaped optical window.

Figure 5:
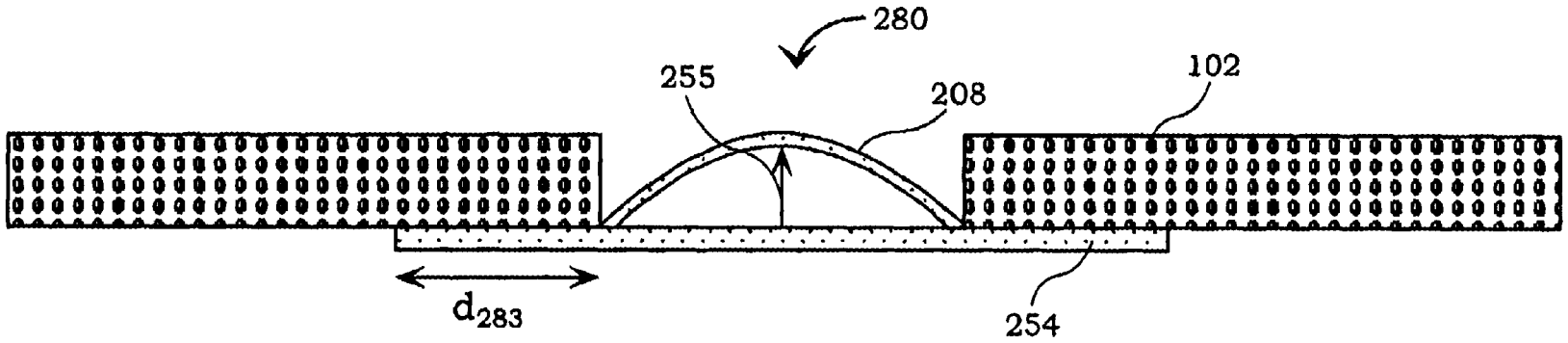
FIG. 5 shows an optical window structure with a flexible optical window in accordance with one embodiment of the present invention.

FIG. 5 shows an optical window structure 280 with a flexible optical window 254 in accordance with one embodiment of the present invention. In this embodiment, a flexible optical window 254 is attached to a polishing pad 102. It should be understood that the flexible optical window 254 may be any dimension and may be made out of any type of material as long as the flexible optical window 254 may controllably bubble up (or bow in) when air pressure is applied to the bottom portion of the flexible optical window 254. It should also be understood that the polishing pad 102 may be made out of any type of material that can effectively polish a wafer such as, for example, polyurethane, cast urethane, and any other type of polymeric material such as, for example a Rodel IC-1000 pad, a Thomas West 813 pad, and the like. In addition, the polishing pad 102 may be any dimension which would enable polishing of the wafer. In one embodiment, the polishing pad 102 is between about 50 mils (0.050 inch) to about 150 mils (0.15 inch) in thickness. The length of the portion of the flexible optical window 254 may be any distance as long as the flexible window 254 may be attached to the polishing pad 102 and still be able to form the shaped optical window 208. It should also be understood that the flexible optical window 254 may be attached to the polishing pad 102 in any way such as, for example, by way of any type of adhesive, pins, etc. In one embodiment, the flexible optical window 254 may be attached to the polishing pad 102 over a distance $d_{283}$ of between ⅛ inch to 1.0 inch. In a preferable embodiment, the distance $d_{283}$ is about 0.5 inch.

When the flexible optical window 254 bubbles up, it moves in a director 255 to form a shaped optical window 208. Therefore, as the polishing pad 102 is polishing the wafer, the shaped optical window 208 forms and slurry that was located on top of the flexible optical window 254 falls away thus increasing optical signal intensity through and from the shaped optical window 208. It should be appreciated that the flexible optical window 254 may bubble up any amount of distance which would permit better slurry draining from the surface of the shaped optical window 208 and permit optimal optical signal transmission to and from an optical detection unit (which may be located below the shaped optical window 208). In this way, more accurate readings of CMP progress may be made.

Figure 6:
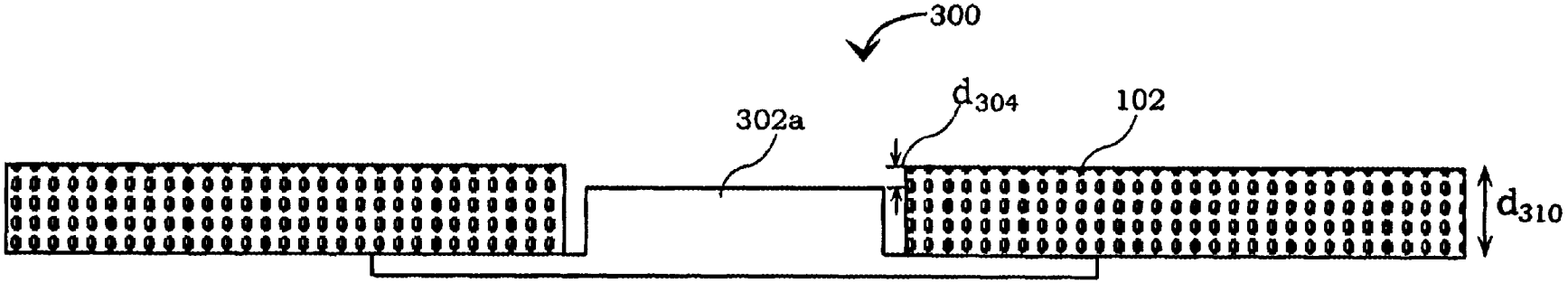
FIG. 6 shows a optical window structure with a pre-formed shaped optical window in accordance with one embodiment of the present invention.

FIG. 6 shows a optical window structure 300 with a preformed shaped optical window 302*a* in accordance with one embodiment of the present invention. In this embodiment, the optical window structure 300 includes the preformed shaped optical window 302*a* that is attached to the polishing pad 102. The polishing pad 102 may be any thickness $d_{310}$ that enables efficient polishing of wafers. In one embodiment, the thickness $d_{310}$ of the polishing pad 102 may be between 0.05 inch to about 0.15 inch thick. In a preferable embodiment, the thickness $d_{310}$ is about 0.075 inch. The preformed shaped optical window 302*a* may be attached to the polishing pad 312 in any manner such as, for example, by any type of adhesive, pins, etc. The pre-formed shaped optical window 302*a* may be any type of material of any shape, size and construction that would enable optical signal transmission but limit the amount of slurry from accumulating between the pre-formed shaped optical window 302*a* and a wafer. In one embodiment, the pre-formed shaped optical window 302*a* may be a transparent, solid, polyurethane block. In another embodiment, the pre-formed shaped optical window 302*a* may be hollow and filled with air or fluid. It should also be appreciated that a top surface of the pre-formed shaped optical window may be any height that enables slurry to be evacuated. In one embodiment, the pre-formed shaped optical window 302*a* can be recessed below the top surface of the polishing pad 102 as shown by distance $d_{304}$ which may be between about 0.010 inch to about 0.030 inch. In a preferable embodiment, the distance $d_{304}$ can be about 0.020 inch. In one embodiment slurry may be outputted into polishing pad grooves as discussed below in reference to FIG. 13. It should be appreciated that the pre-formed shaped optical window may be any shape when seen from above such as, for example, an oval shape as described in further detail in reference to FIG. 3. Therefore, the optical window structure 300 reduces slurry accumulation in an optical window opening and therefore maintains optimal optical signal transmission and reception by an optical detection unit. This enables accurate polishing utilizing advanced end point detection.

Figure 7:
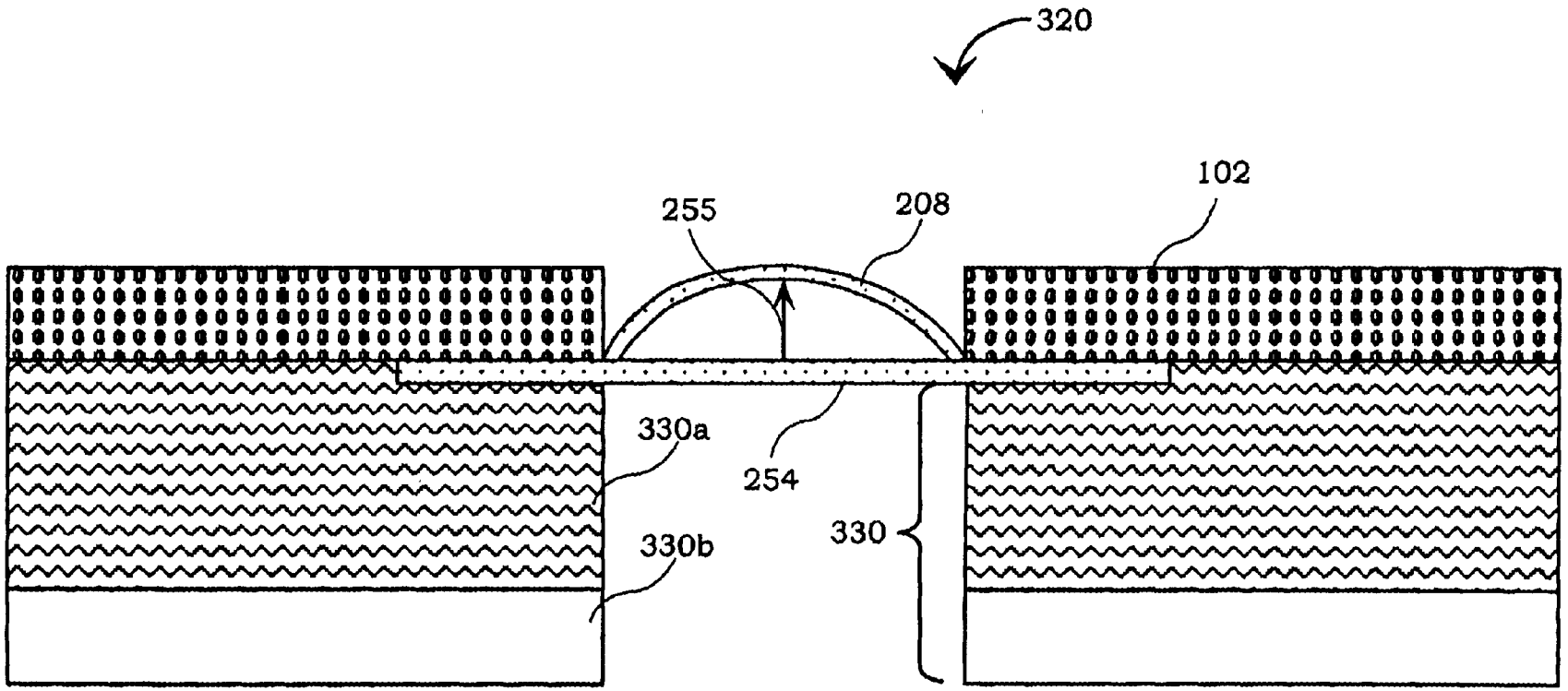
FIG. 7 illustrates a side view of an optical window structure in accordance with one embodiment of the present invention.

FIG. 7 illustrates a side view of an optical window structure 320 in accordance with one embodiment of the present invention. In this embodiment, the optical window structure 320 includes a polishing pad 102, a support layer 330, and a flexible optical window 254. The polishing pad 102 may be any type of pad with any type dimension that would enable accurate and efficient polishing such as, for example, an IC 1000 pad made by Rodel Inc. In one embodiment, the polishing pad 102 may be made up of a polymeric polishing belt and may be between about 0.01 inch and about 0.1 inch. In another embodiment, the polishing pad 102 may be about 0.05 inch thick. In one embodiment, the support layer 330 includes a cushioning layer 330*a* and a reinforcement layer 330*b*. The reinforcement layer may be between about 0.005 inch to about 0.040 inches and is preferably made out of stainless steel although other types of supportive materials may be utilized such as, for example, kevlar, etc. The cushioning layer 330*a* may be made out of any type of material that may provide cushioning to the polishing pad 102 such as, for example, a polyurethane layer made by Thomas West, Inc. In this embodiment, the flexible optical window can be attached between the polishing pad 102 and the support layer 330. The flexible optical window 254 may be held in place by an adhesive or by a mechanical connection such as, for example, a pin. When air pressure from an air bearing platen is applied to the bottom portion of the flexible optical window 254, the flexible optical window 254 moves in a direction 255 and a shaped optical window 208 forms. In this way, slurry that may have accumulated on the flexible optical window 254 may slide off thus optimizing optical signal transmission and reception in end point detection.

Figure 8:
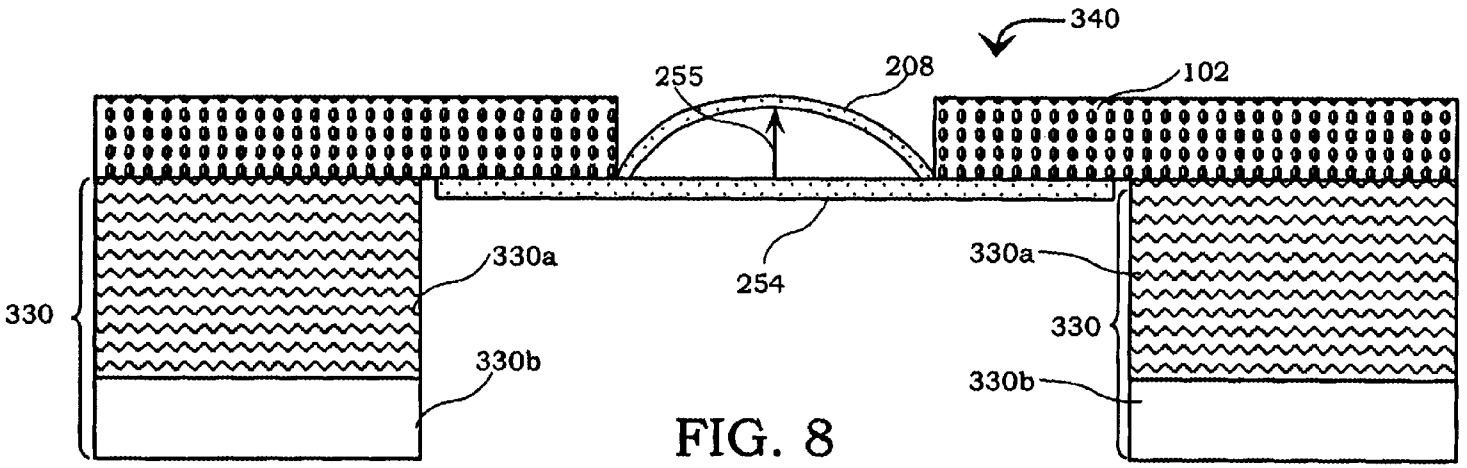
FIG. 8 illustrates a side view of a optical window structure with a flexible optical window in accordance with one embodiment of the present invention.

FIG. 8 illustrates a side view of a optical window structure 340 with a flexible optical window 254 in accordance with one embodiment of the present invention. In this embodiment, a polishing pad 102 is attached to a support layer 330 with the flexible optical window 254 attached to the polishing pad 102 but not to the support layer 330. The support layer 330 includes a cushioning layer 330*a* and a reinforcement layer 330*b*. In this embodiment, the flexible optical window 254 is only attached to the polishing pad 102 and is not attached or connected to another layer below it. It should be understood that the flexible optical window 254 may be attached to the polishing pad 102 by any type of adhesive or by way of any mechanical connection. As described in reference to FIG. 7 above, when air pressure from an air platen pushes upward, the flexible optical window bubbles upward in direction 255 to form a shaped optical window 208. Consequently, whenever the optical window structure 340 moves over the platen during CMP (and under a wafer), the shaped optical window 208 forms.

Figure 9:
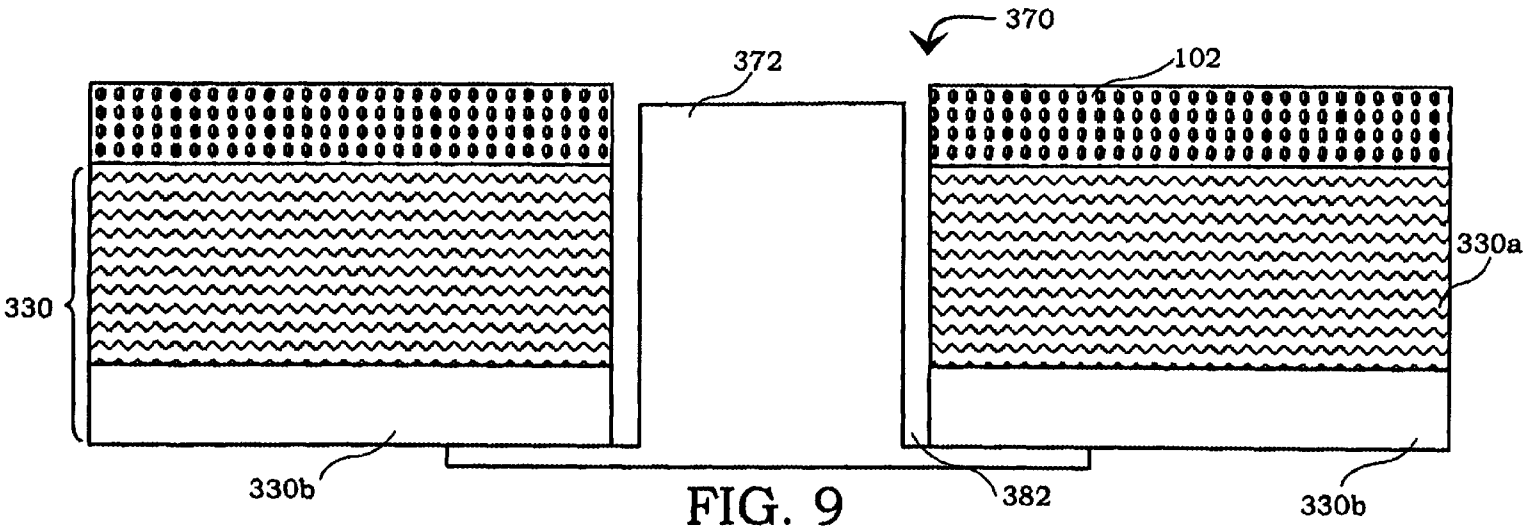
FIG. 9 illustrates an optical window structure with a pre-formed shaped optical window in accordance with one embodiment of the present invention.

FIG. 9 illustrates an optical window structure 370 with a preformed shaped optical window 372 in accordance with one embodiment of the present invention. In this embodiment, the optical window structure 370 includes a polishing pad 102, a support layer 330, and the pre-formed shaped optical window 372. The support layer 330 includes a cushioning layer 330*a* and a reinforcement layer 330*b* which are connected to each other by any type of adhesive. The support layer 330 may also attached to the polishing pad 102 by an adhesive. Examples of adhesives include 3M 442, 3M 467 MP, 3M 447, a rubber-based adhesive, etc. A gap 382 between the pre-formed shaped optical window 372 and the polishing pad 102 may be any distance such as, for example, between about 0.02 inches to about 0.12 inches. In a preferable embodiment, the gap 382 may be about 0.03937 inches. In addition, in another embodiment as described in further detail in reference to FIGS. 12 and 13, the top surface of the pre-formed shaped optical window 372 may be recessed.

Similar to the slurry removal mechanism as described below in reference to FIG. 12, slurry which would typically accumulate on prior art optical windows can be evacuated off of the pre-formed shaped optical window 372 into a groove or a plurality of grooves of the polishing pad 102. Therefore, a top surface of the pre-formed shaped optical window 372 may stay relatively clear of slurry thus enabling optimal transmission and reception of optical signals by an optical detection unit. Such optimization of optical signal transmission and reception enables better polishing distance measurement resolution thereby increasing accuracy of CMP procedures. This in turn may then increase wafer yield and decrease wafer production costs. In addition, the pre-formed optical window 372 may extend the useful life of the polishing pad 102 and the support layer 330 because if for some reason, the pre-formed optical window fails, then the pre-formed optical window may be replaced (by re-adhesion) without disposing of the polishing pad 102 and the support layer 330.

Figure 10A:
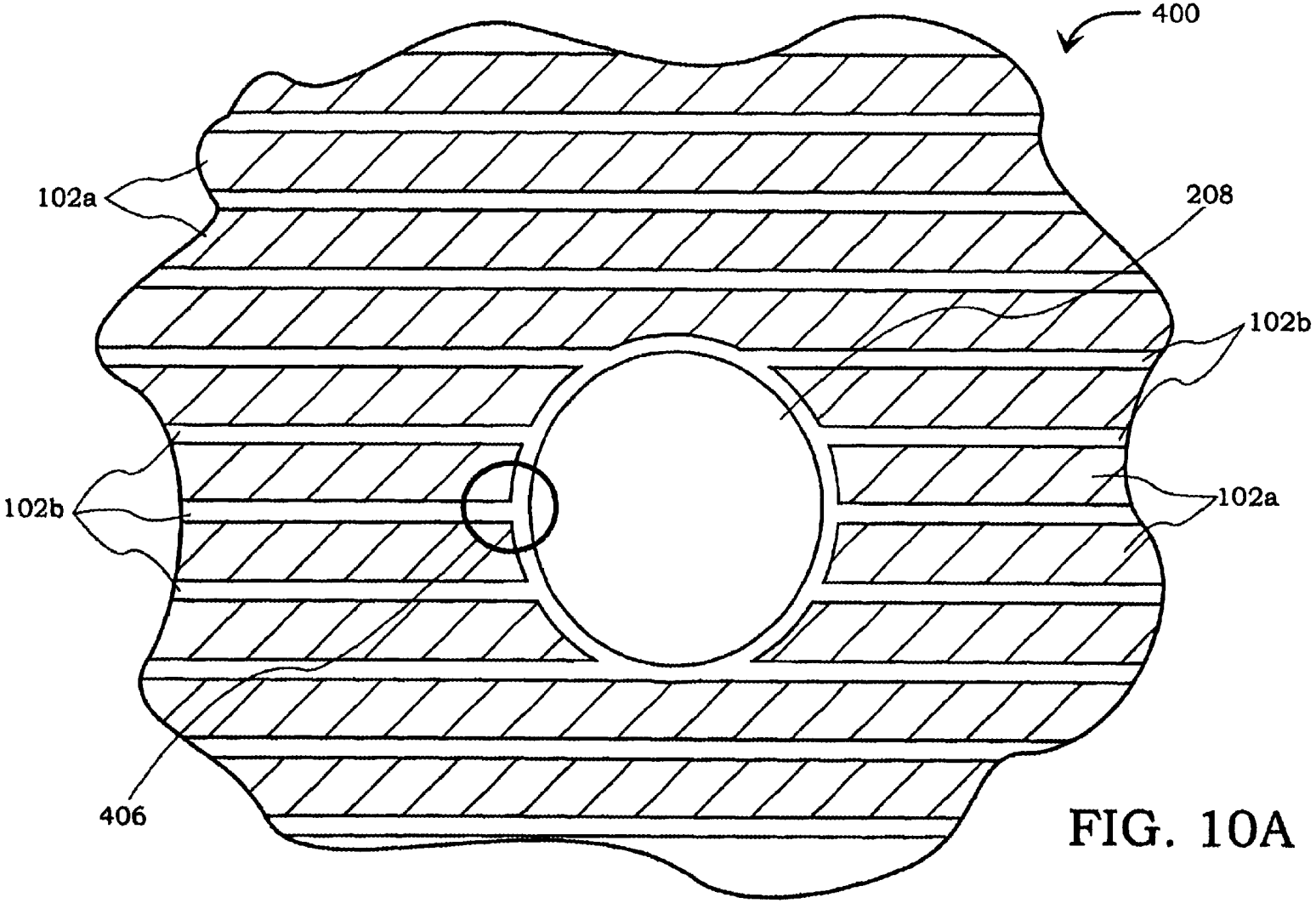
FIG. 10A shows a magnified top view of an optical window structure in accordance with one embodiment of the present invention.

FIG. 10A shows a magnified top view of an optical window structure 400 in accordance with one embodiment of the present invention. In this embodiment, the optical window structure 400 includes a shaped optical window 208, a plurality of polishing pad grooves 404, and a plurality of polishing pad surfaces 402. Region 406 is a section of the optical window structure 400 that is discussed in reference to FIG. 10B below.

Figure 10B:
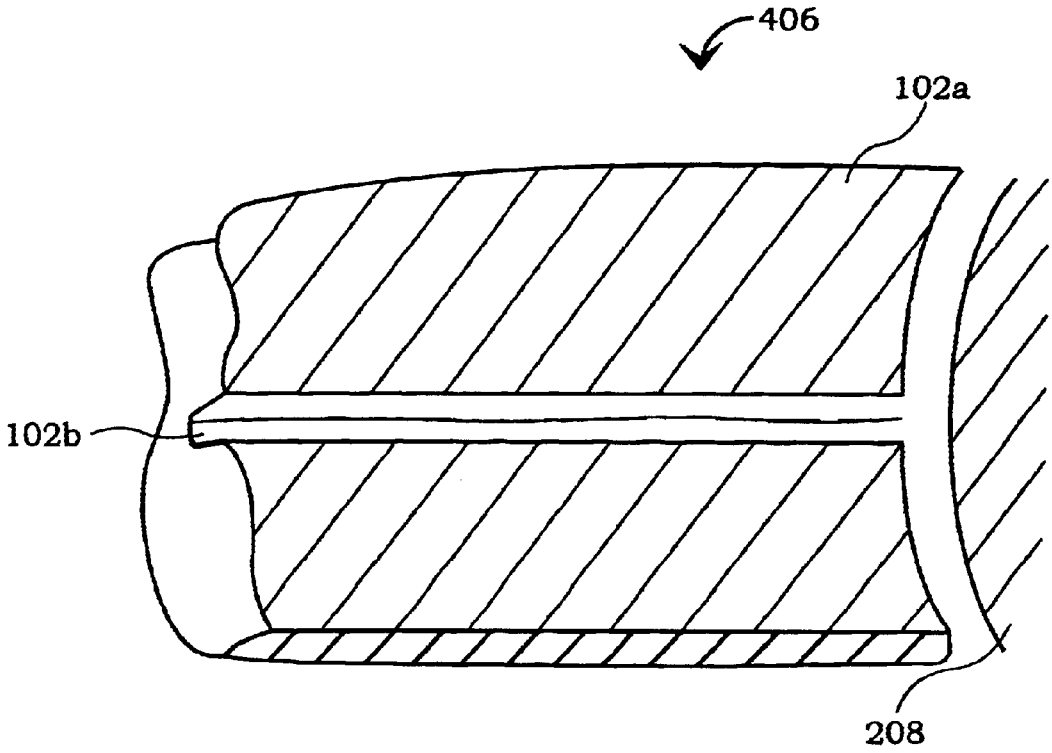
FIG. 10B shows a magnified view of the region of the optical window structure of FIG. 10A.

FIG. 10B shows a magnified view of the region 406 of the optical window structure 400 of FIG. 10A. In this embodiment, the region 406 illustrates one groove of the plurality of polishing grooves 404. It should be understood that the groove may be any size that would enable effective wafer polishing and good slurry evacuation from a top surface of a shaped optical window. In one embodiment, the groove may be between about 10 mils to about 50 mils in depth. The region 406 also shows portions of the plurality of polishing pad surfaces 402. The region 406 further includes the shaped optical window 208 which may be configured to run slurry off of a top surface into the plurality of polishing grooves 404 as discussed in further detail in reference to FIGS. 11–13.

Figure 11:
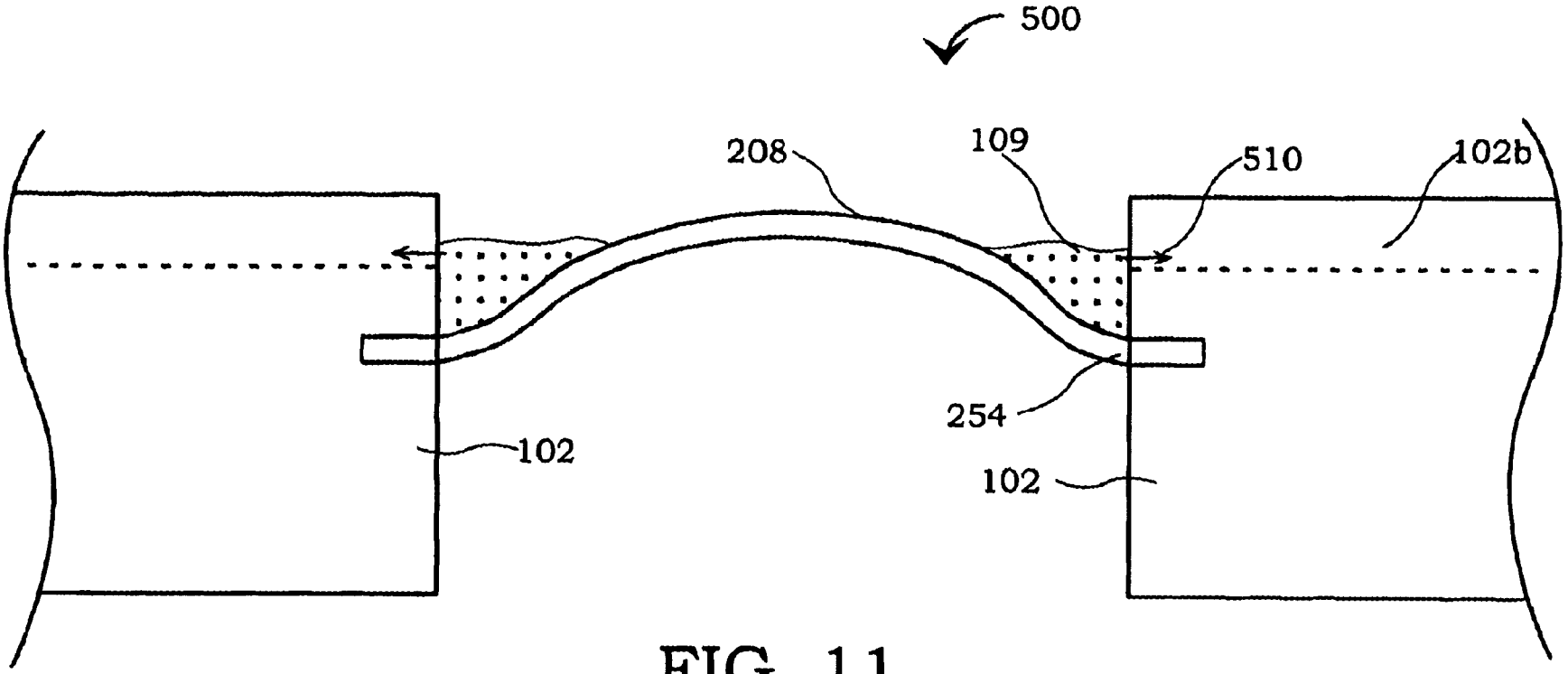
FIG. 11 shows an optical window structure during CMP in accordance with one embodiment of the present invention.
Figure 12:
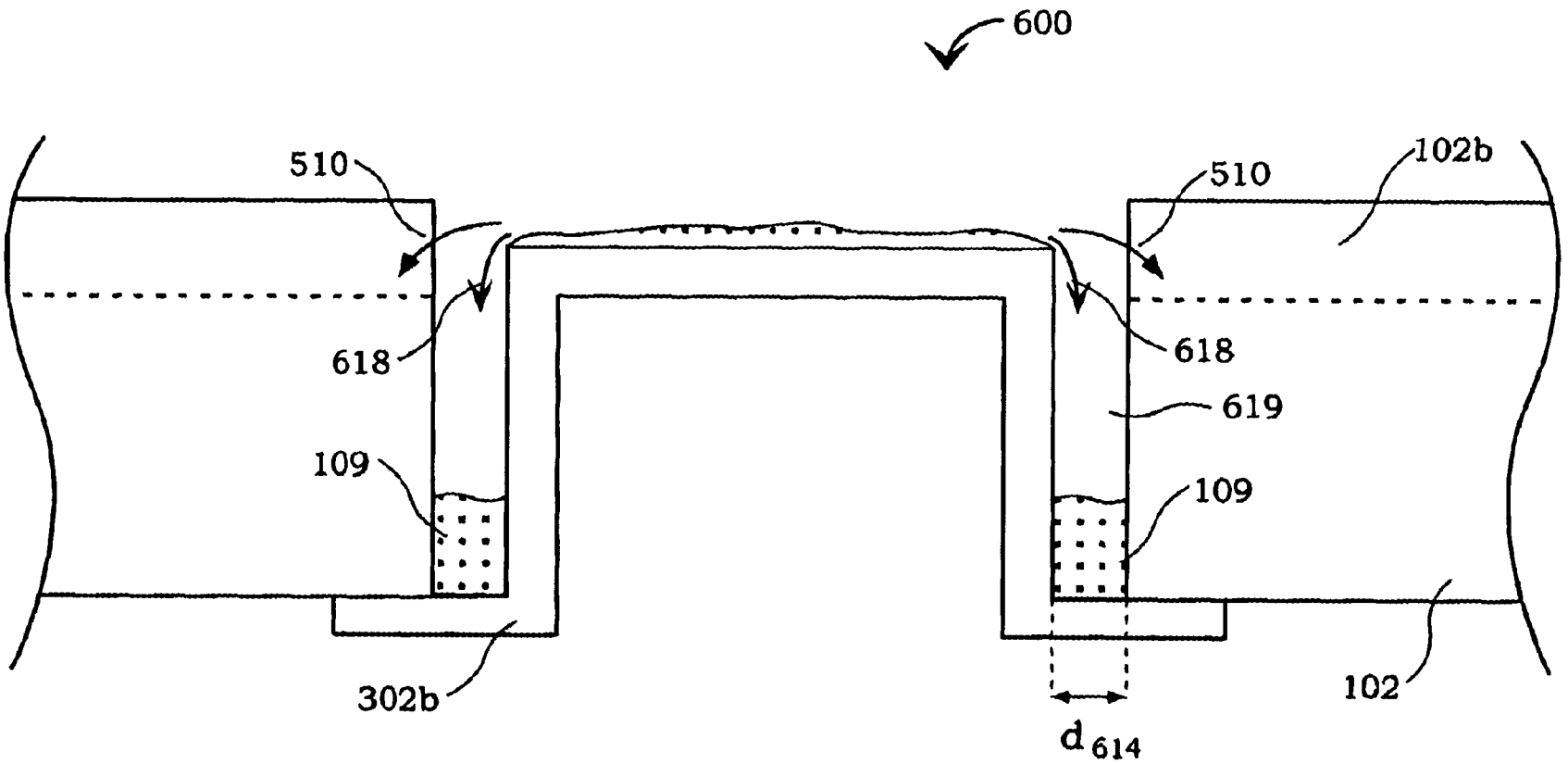
FIG. 12 shows an optical window structure with a pre-formed shaped optical window during a CMP process in accordance with one embodiment of the present invention.
Figure 13:
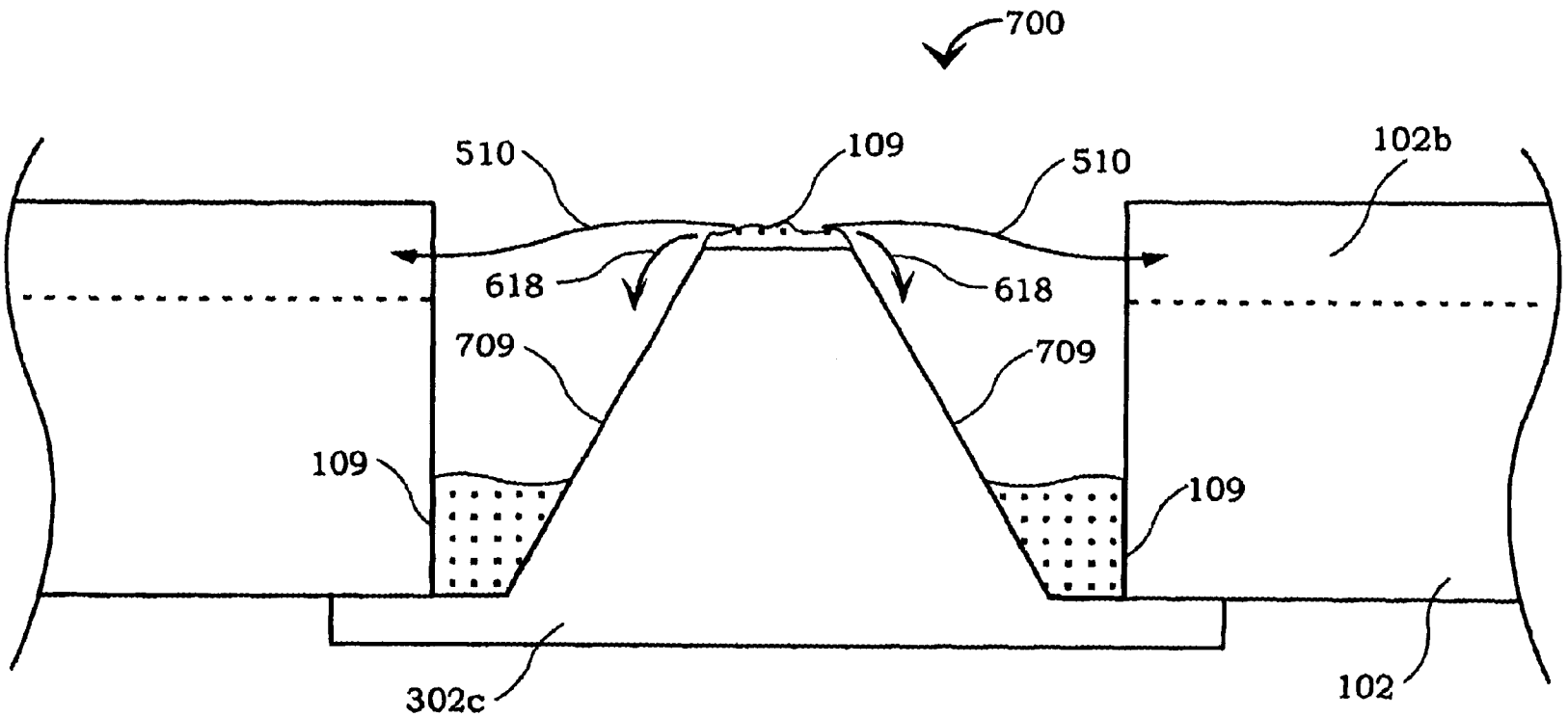
FIG. 13 shows an optical window structure with a pre-formed shaped optical window that has slanted sides utilized during a CMP process in accordance with one embodiment of the present invention.

It should be understood that the embodiments described in FIGS. 11 through 13 may be utilize a multi-layer polishing pad structure (such as those described in reference to FIGS. 7–9 or a single layer polishing pad structure (such as those described in reference to FIGS. 5 and 6.

FIG. 11 shows an optical window structure 500 during CMP in accordance with one embodiment of the present invention. In this embodiment, the optical window structure 500 includes a shaped polishing window 208 that can be attached to a polishing pad 102. When the optical window structure 500 rolls over an air platen, an air pressure 506 pushes up and forms the shaped polishing window 208. When this occurs a slurry 109 that was on top of the shaped polishing window 208 falls to the side of the shaped polishing window 208 or flows into a plurality of grooves 404 by flow directions 510. As can be seen, by use of the optical window structure 500, slurry accumulation on top of the shaped optical window 208 may be significantly reduced and therefore increase optical signal transmission intensity thereby substantially optimizing accuracy of end point detection.

FIG. 12 shows an optical window structure 600 with a pre-formed shaped optical window 302*b* during a CMP process in accordance with one embodiment of the present invention. In this embodiment, the pre-formed shaped optical window 302*b* can be attached to a polishing pad 102 preferably by an adhesive. In one embodiment, during CMP, slurry 109 may be applied to the polishing pad 102. The slurry 109 may then enter into an optical window opening where the preformed shaped optical window 302*b* resides. Because the pre-formed shaped optical window 302*b* is raised to a small distance below a top surface of the polishing pad 102, the slurry 109 does not accumulate on the top surface of the pre-formed shaped optical window 302*b*. Instead, in one embodiment, the slurry 109 may flow off of the pre-formed shaped optical window 302*b* into a plurality of polishing pad grooves 404 as shown by direction 616. The slurry 109 may also flow into a channel between the pre-formed shaped optical window 302*b* and the polishing pad 102 as shown by direction 618. Consequently, because of the pre-formed shaped optical window 302*b*, the amount of space for the slurry 109 to accumulate which may block optical signals is reduced significantly and therefore increases optical signal transmission and reception by an optical detection unit. It should be understood that the pre-formed shaped optical window may be any thickness that would reduce slurry accumulation compared to a flat optical window. In one embodiment, the pre-formed shaped optical window may have any thickness that would leave a distance of between about 0.010 inch to about 0.030 inch between a top surface of the pre-formed shaped window 302*b* and a top surface of the polishing pad 102. A gap 619 between the preformed shaped optical window 302*b* and the polishing pad 102 may be between about 0.02 inches to about 0.12 inches as shown by distance $d_{614}$. In a preferable embodiment, the distance $d_{614}$ is about 0.03937 inches.

Consequently, through the slurry evacuation mechanism as exemplified by FIG. 12, the present invention may enable accurate and efficient CMP monitoring so more exact amounts of a wafer surface may be polished thereby increasing wafer production yields and lower wafer production costs.

FIG. 13 shows an optical window structure 700 with a pre-formed shaped optical window 302*c* that has slanted sides 709 utilized during a CMP process in accordance with one embodiment of the present invention. In this embodiment, the preformed shaped optical window 302*c* is attached to a polishing pad 102 by an adhesive. In one embodiment, during CMP, slurry 109 is applied to the polishing pad 102. The slurry 109 may then enter into an optical window opening. Because of the pre-formed shaped optical window 302*c* is raised to a small distance away from a top surface of the polishing pad 302*c*, the slurry 109 does not accumulate on a top surface of the pre-formed shaped optical window 302*c*. The pre-formed shaped optical window 302*c* has slanted sides 709 which enables the slurry 109 to slide off of the pre-formed shaped optical window 302*c*. In one embodiment, the slurry 109 may also flow into a plurality of polishing pad grooves 404. It should be understood that a depth of the plurality of grooves 404 may be any distance as long as the groove may effectively evacuate slurry from the pre-formed shaped optical window 302*c*.

Consequently, because of the pre-formed shaped optical window 302*c*, the amount of space for the slurry 109 to accumulate which may block optical signals is reduced significantly and therefore increases optical signal transmission and reception by an optical detection unit. It should be understood that the pre-formed shaped optical window 302*c* may be any thickness that would reduce slurry accumulation compared to a flat optical window. In one embodiment, the pre-formed shaped optical window may be between about 0.010 inch to about 0.030 inch below a top surface of the polishing pad 102.

While this invention has been described in terms of several preferred embodiments, it will be appreciated that those skilled in the art upon reading the preceding specifications and studying the drawings will realize various alterations, additions, permutations and equivalents thereof. It is therefore intended that the present invention includes all such alterations, additions, permutations, and equivalents as fall within the true spirit and scope of the invention.

What is claimed is:

1. An optical window structure, comprising:

a support layer, the layer including a reinforcement layer and a cushioning layer, the cushioning layer being disposed above the reinforcement layer;

a polishing pad, the polishing pad being attached to a top surface of the support layer;

an optical window opening; and a shaped optical window, the shaped optical window being configured to at least partially protrude into the optical window opening in the support layer and the polishing pad during operation, and the shaped optical window being separated from a side wall of the polishing pad.

2. An optical window structure as recited in claim 1, wherein the shaped optical window is recessed between about 0.010 inch to about 0.030 inch below a top surface of the polishing pad.

3. An optical window structure as recited in claim 1, wherein the shaped optical window is one of a transparent material and a semi-transparent material.

4. An optical window structure as recited in claim 1, wherein the shaped optical window is one of a solid material and a hollow material.

5. An optical window structure as recited in claim 1, wherein the optical window opening is oval shaped.

6. An optical window structure as recited in claim 1, wherein the optical window opening has a length in an axis of a polishing pad direction of about 0.5 inch to about 1.7 inches.

7. An optical window structure as recited in claim 6, wherein the optical window opening has a width in an axis perpendicular to a polishing pad direction of about 0.4 inch to about 1.3 inches.

8. An optical window structure as recited in claim 1, wherein the polishing pad is a polymeric material, the cushioning layer is a polymeric material, and the reinforcement layer is one of stainless steel and a kevlar-type material.

9. An optical window structure as recited in claim 1, wherein the polishing pad is seamless.

10. An optical window structure as recited in claim 1, wherein the shaped optical window is configured to enable slurry evacuation through a plurality of polishing pad grooves.

11. An optical window structure as recited in claim 1, wherein the shaped optical window is pre-formed.

12. An optical window structure as recited in claim 1, wherein the shaped optical window is attached to a bottom surface of one of the polishing pad and the support layer.

13. An optical window structure as recited in claim 1, wherein the shaped optical window is configured to reduce slurry buildup on a top surface of the shaped optical window.

14. An optical window structure as recited in claim 13, wherein the shaped optical window is configured to enable light transmission between a bottom and a top portion of the optical window structure.

15. An optical window structure, comprising:

a support layer, the support layer including a reinforcement layer and a cushioning layer, the cushioning layer being disposed above the reinforcement layer;

a polishing pad, the polishing pad being attached to a top surface of the support layer; and a flexible optical window, the flexible optical window being configured to at least partially protrude into an optical window opening in the support layer and the polishing pad when air pressure is applied to a bottom surface of the flexible optical window, and the flexible optical window, when partially protruded, being separated from a side wall of the polishing pad.

16. An optical window structure as recited in claim 15, wherein the shaped optical window is attached to one of the polishing pad and the support layer.

17. An optical window structure as recited in claim 15, wherein the shaped optical window is configured to reduce slurry buildup on a top surface of the shaped optical window.

18. An optical window structure as recited in claim 17, wherein the shaped optical window is configured to enable light transmission between a bottom and a top portion of the optical window structure.

19. An optical window structure as recited in claim 15, wherein a top surface of the shaped optical window is recessed between about 0.010 inch to about 0.030 inch below a top surface of the polishing pad.

20. An optical window structure as recited in claim 15, wherein the shaped optical window is one of a transparent material and a semi-transparent material.

21. An optical window structure as recited in claim 15, wherein the shaped optical window is one of a solid material and a hollow material.

22. An optical window structure as recited in claim 15, wherein the optical window opening is oval shaped.

23. An optical window structure as recited in claim 15, wherein the optical window opening has a length in an axis of a polishing pad direction of about 0.5 inch to about 2.3 inches.

24. An optical window structure as recited in claim 23, wherein the optical window opening has a width in an axis perpendicular to a polishing pad direction of about 0.3 inch to about 1.7 inches.

25. An optical window structure as recited in claim 15, wherein the polishing pad is a polymeric material.

26. An optical window structure as recited in claim 15, wherein the polishing pad is seamless.

27. An optical window structure as recited in claim 15, wherein the shaped optical window is configured to enable slurry evacuation through a plurality of polishing pad grooves.

28. An optical window structure as recited in claim 15, wherein the polishing pad is a polymeric material, the cushioning layer is a polymeric material, and the reinforcement layer is at least one of stainless steel and a kevlar-type material.

29. An optical window structure, comprising:

a support layer, the support layer including a reinforcement layer and a cushioning layer, the reinforcement layer being stainless steel and the cushioning layer being polyurethane;

a polishing pad, the polishing pad being attached to a top surface of the support layer, and the polishing pad being a polymeric material; and a shaped optical window, the shaped optical window being configured to at least partially protrude into an oval optical window opening in the polishing pad, and a top surface of the shaped optical window being configured to be recessed between about 0.010 inch to about 0.030 inch below a top surface of the polishing pad, and the shaped optical window being one of a transparent material and a semi-transparent material, and the shaped optical window being separated from a side wall of the polishing pad.

30. An optical window structure as recited in claim 29, wherein the shaped optical window is attached to a bottom surface of the polishing pad by an adhesive.

31. An optical window structure as recited in claim 29, wherein the shaped optical window is configured to reduce slurry buildup on a top surface of the shaped optical window.

32. An optical window structure as recited in claim 31, wherein the shaped optical window is configured to enable light transmission between a bottom and a top portion of the optical window structure.

33. An optical window structure, comprising:

a support layer, the layer including a reinforcement layer and a cushioning layer;

a polishing pad, the polishing pad being attached to a top surface of the support layer;

an optical window opening; and a shaped optical window, the shaped optical window being configured to at least partially protrude into the optical window opening in the support layer and the polishing pad during operation, and the shaped optical window being separated from a side wall of the polishing pad;

wherein the polishing pad is a polymeric material, the cushioning layer is a polymeric material, and the reinforcement layer is stainless steel.

34. An optical window structure, comprising:

a support layer, the layer including a reinforcement layer and a cushioning layer, the reinforcement layer being stainless steel;

a polishing pad, the polishing pad being attached to a top surface of the support layer;

an optical window opening; and a shaped optical window, the shaped optical window being configured to at least partially protrude into the optical window opening in the support layer and the polishing pad during operation, and the shaped optical window being separated from a side wall of the polishing pad.

35. An optical window structure as recited in claim 34, wherein the shaped window is attached to a bottom surface of the support layer and the shaped window is recessed below a top surface of the polishing pad.

36. An optical window structure as recited in claim 34, wherein the separation between the shaped optical window and the side wall of the polishing pad forms a gap.

37. An optical window structure, comprising:

a multi-layer polishing pad;

an optical window opening: and a shaped optical window, the shaped optical window being configured to at least partially protrude into the optical window opening in the multi-layer polishing pad, and the shaped optical window being separated from a side wall of the polishing pad, wherein a polishing layer of the multi-layer polishing pad is secured to a support layer through direct casting of polyurethane on the support layer, and the multi-layer polishing pad includes at least one of a stainless steel reinforcement layer and a kevlar-type reinforcement layer.

* * * * *